United States Patent [19]

Brower

[11] Patent Number: 4,866,960

[45] Date of Patent: Sep. 19, 1989

[54] PADLOCK PROTECTOR

[76] Inventor: Rupard A. Brower, 3521 NW. Hermosa Dr., Kansas City, Mo. 64150

[21] Appl. No.: 206,494

[22] Filed: Jun. 14, 1988

[51] Int. Cl.[4] ..... E05B 67/38

[52] U.S. Cl. ..... 70/56; 70/417

[58] Field of Search ..... 70/54, 56, 55, 416, 70/417

[56] References Cited

U.S. PATENT DOCUMENTS

| | | | |
|---|---|---|---|
| 3,392,555 | 7/1968 | Beaver | 70/56 |
| 3,916,654 | 11/1975 | Mudge, Jr. | 70/56 |
| 4,095,828 | 6/1978 | East | 70/54 X |
| 4,106,315 | 8/1978 | Dohanyos | 70/56 |
| 4,238,941 | 12/1980 | Halopoff | 70/56 |
| 4,290,281 | 9/1981 | Knaack et al. | 70/54 |
| 4,548,058 | 10/1985 | Bahry et al. | 70/56 |

FOREIGN PATENT DOCUMENTS

| | | | |
|---|---|---|---|
| 2185519 | 7/1987 | United Kingdom | 70/54 |

*Primary Examiner*—Gary L. Smith

*Assistant Examiner*—Douglas E. Ringel

*Attorney, Agent, or Firm*—Kokjer, Kircher, Bradley, Wharton, Bowman & Johnson

[57] ABSTRACT

A device for protecting a padlock from tampering. The device consists of two separate plate sections which wrap around respective posts of a gate to be padlocked and are secured onto the posts via nut and bolt assemblies. Extending outwardly on the front of each plate section is a semicircular shield which, when the two plates are brought together, will meet the shield on the companion plate and encircle the padlock. On the back side of one plate section is a housing which is also secured to the plate section via a nut and bolt assembly and which receives the shackle of a padlock. To lock the gate (or other similar opening), the padlock shackle is passed through an opening in the plate section, into the housing, and through an opening in the companion plate section. An alternative form of the invention utilizes hinged latch plates secured to the flat portion of a solid door instead of the plate sections of the former embodiment.

5 Claims, 1 Drawing Sheet

PADLOCK PROTECTOR

BACKGROUND OF THE INVENTION

This invention relates generally to security devices and, more particularly, to a device for protecting a padlock from tampering when the lock is being used to hold two relatively movable members.

A typical padlock is constructed with a body portion which includes the locking mechanism and a movable arm which projects from the body and is connected to a second arm by a curved bight portion. Most break-ins where padlocks are used for security result from the arms being cut with a bolt cutter. Previous attempts to provide some type of armorment for a padlock have resulted in unwieldy attachments which are often cumbersome and interfere with movement of the objects being locked together.

OBJECT AND SUMMARY OF THE INVENTION

It is a primary objective of the present invention to provide a device for protecting a padlock from tampering which is compact and does not significantly interfere with the two movable objects being locked together.

Another object of the present invention is to provide a padlock protective device which not only seals the padlock from cutting devices but also holds the padlock substantially stationary thereby substantially precluding the padlock from being turned to expose the arms of the padlock to a cutting device.

Another one of the aims of my invention is to provide a protective device for a padlock which is adaptable to protect padlocks installed on gate posts as well as flat doors and hinged as well as stationary lock plates.

Another one of the objects of my invention is to provide a padlock protective device which shields both the arms of the padlock as well as the bight portion from cutting devices.

BRIEF DESCRIPTION OF THE DRAWINGS

Other objects of the invention will be made clear or become apparent from the following description and claims when read in light of the accompanying drawing, wherein:

DETAILED DESCRIPTION OF THE PREFERRED EMBODIMENTS

Figure 1:
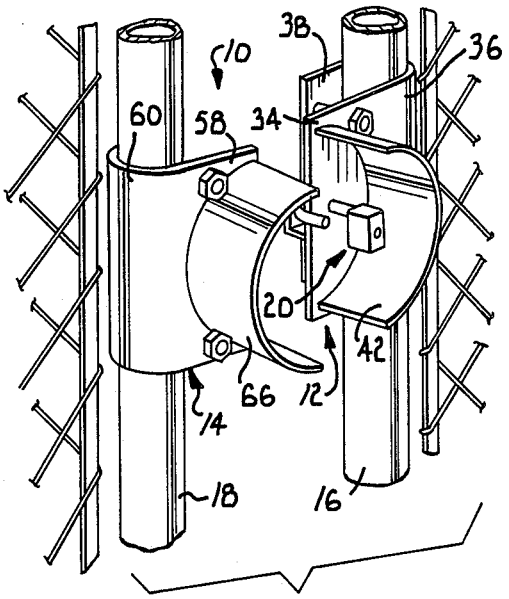
FIG. 1 is a perspective view of a padlock protective device according to the present invention.
Figure 2:
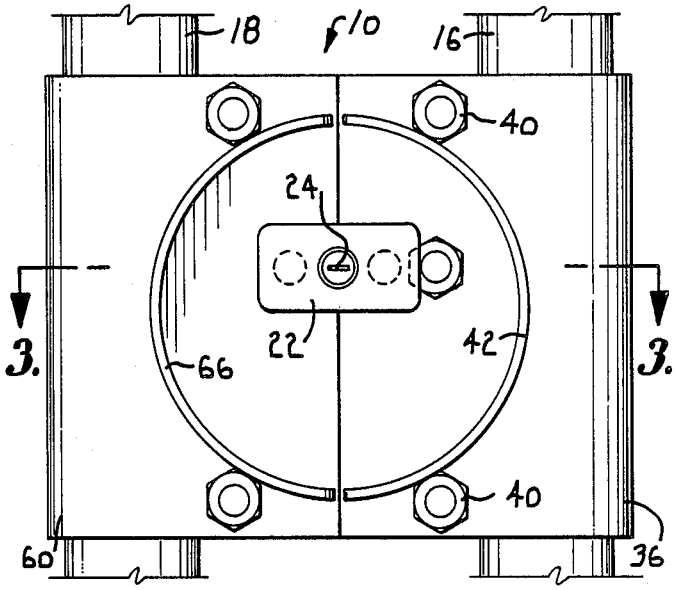
FIG. 2 is a front elevational view of the device shown in FIG. 1.

Referring initially to FIGS. 1 and 2, the protective device of the present invention is designated generally by the numeral 10 and includes first and second protective members 12 and 14 adapted to be secured to two objects to be locked together such as gate posts 16 and

18. Device 10 is intended to protect a padlock 20 from damage by a person trying to break the lock.

Figure 3:
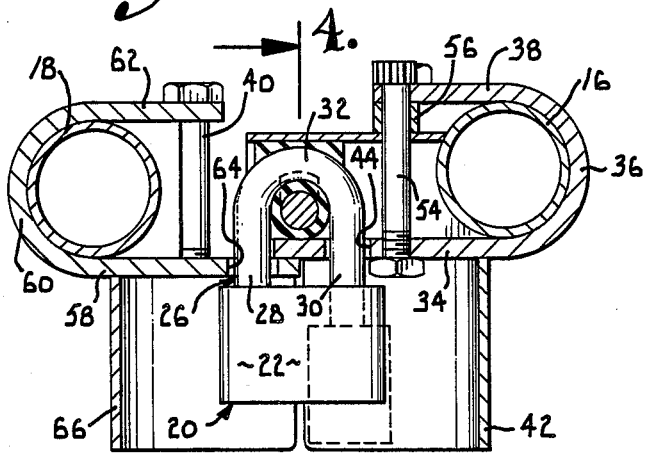
FIG. 3 is a horizontal cross-sectional view taken along line 3—3 of FIG. 2.
Figure 4:
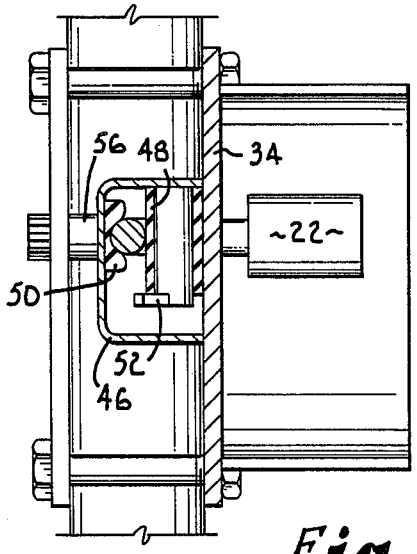
FIG. 4 is a vertical cross-sectional view taken along line 4—4 of FIG. 3.

As best seen in FIG. 3, padlock 20 includes a body portion 22 which includes the locking mechanism and presents a keyhole 24 as well as a shackle 26 comprised of first and second straight arms 28 and 30 interconnected by a U-shaped bight portion 32.

Referring now in greater detail to protective member 12, this member is constructed of a rigid steel plate or other comparable material and includes a front flat planar section 34, integral bight section 36 and an integral flat back planar section 38. Manifestly, the bight section 36 presents a line of curvature of a radius sufficient to fit around gate post 16. Nut and bolt assemblies 40 extend through aligned openings in planar sections 34 and 48 to hold member 12 rigid with gate post 16. Extending outwardly from planar section 34 at a 90° angle relative to the latter is a first curvilinear shield plate 42. Plate 42 is welded or otherwise rigidly secured to section 34 and extends in an arc of approximately 180°. As best seen in FIG. 3, planar section 34 is provided with an opening 44.

Mounted on the inside surface of planar section 34 is a U-shaped cover plate housing 46. Extending downwardly from the uppermost horizontal surface of housing 46 is a tubular spacer pin 48 which is rigid with the housing. Secured to the vertical surface of housing 46 is a resilient boot 50 which is held in spaced relationship to pin 48. The lowermost end of pin 48 has a horizontally extending projection 52 rigidly secured thereto. Planar sections 34 and 38 are provided with openings which are in alignment with an opening in housing 46 for receiving a nut and bolt assembly 54. Bolt 54 passes through spacer 56 and upon tightening holds housing 46 rigid against planar section 34.

It will be appreciated that not only do shield plates 42 and 66 protect the padlock 20, but housing 46 protects the shackle 26 from the inside of the area closed by gate posts 16 and 18. Housing 46, by virtue of the rigid depending spacer pin 48 which extends inside of the bight portion of shackle 26, cannot be removed so long as padlock 20 is in its locking position.

Referring now to details of construction of protective member 14, member 14 has a front planar section 58 which merges into and is integral with a bight section 60 that in turn merges into and is rigid with a back planar section 62. Planar sections 58 and 62 are provided with through aligned openings for receiving nut and bolt assemblies 40. An opening 64 in planar section 58 is of a size to accommodate straight arm 28 of the padlock shackle 26. Extending outwardly from planar section 58 at a 90° angle relative to the latter is a second curvilinear shield plate 66 which extends through an arc of approximately 180 °.

In use, when two objects such as gate posts 16 and 18 are to be locked together, protective device 10 is installed as aforedescribed and, when the two posts are brought together, planar sections 34 and 58 will be brought into overlapping abutting relationship as indicated in FIG. 3. This brings each of the two shield plates 42 and 66 into closely spaced or abutting relationship where they cooperate to substantially surround padlock 22 over 360°.

The padlock is opened and prior to bringing the two gate posts together shackle 26 is inserted through first opening 44 and turned so that arm 28 will pass through opening 44, around spacer pin 48 and be in a position to pass through opening 64 once the two protective members are brought together. The padlock 22 is shown in its fully locked position in FIG. 3. Manifestly, it will be appreciated that spacer pin 48 and resilient boot 50 cooperate to substantially preclude lateral movement of the padlock relative to protective members 12 and 14 once the padlock has assumed a locking position. Shield plates 42 and 66 effectively block any access to padlock shackle 26 by bolt cutters or saw blades while housing 46 protects the side of shackle 26 opposite plates 42 and 46. It will be appreciated that it may be desirable to weld nut and bolt assemblies 40 to the members 12 and 14 to preclude their removal.

Figure 5:
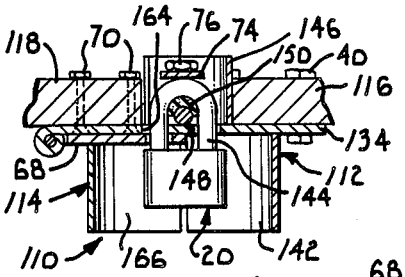
FIG. 5 is a horizontal cross-sectional view illustrating an alternative form of the invention.
Figure 6:
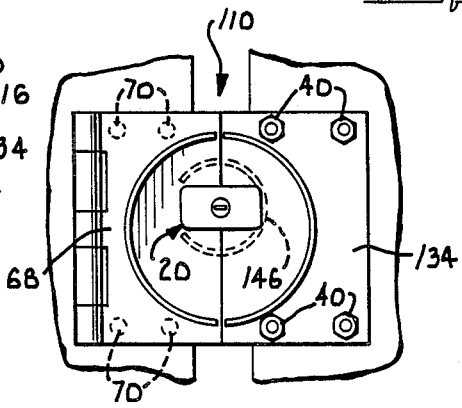
FIG. 6 is a front elevational view of the alternative form of the invention shown in FIG. 5.

An alternative form of the invention is shown in FIGS. 5 and 6 and is designated generally by the numeral 110. Protective device 110 is particularly adapted for use in closing two solid members such as doors 116 and 118. A hinged latch plate 68 is secured to door 118 by nut and bolt assemblies 70. A protective member 112 includes a planar section 134 which is secured to door 116 by nut and bolt assemblies 40. Planar section 134 has an opening 144 which receives the shackle arms of padlock 20. Extending outwardly from planar section 134 at a 90° angle relative to the latter is a first curvilinear shield plate 142 which extends over an arc of approximately 180 °. Extending rearwardly from planar section 134 is an open backed protective housing 146. Housing 146 also mounts a U-bolt 148, the bight portion of which serves as a spacer pin. A resilient boot 150 is secured to the inside of the bight portion of U-bolt 148 and the parallel arms of the U-bolt mount a back protective plate 74 which is secured by nuts 76, one of which is visible in FIG. 5.

The second protective member 114 is formed by the hinge plate 68 together with a curvilinear shield plate 166 which extends outwardly from the hinge plate at a right angle and covers an arc of approximately 180 °. Hinge plate 68 is provided with an opening 164 through which one arm of the padlock shackle 26 is passed.

Operation of the device 110 is identical to the preferred embodiment discussed above and again it will be appreciated that the padlock is substantially precluded from damage by bolt cutters or saws by the protective shield plates 142 and 166 as well as back protective plate 74.

Figure 7:
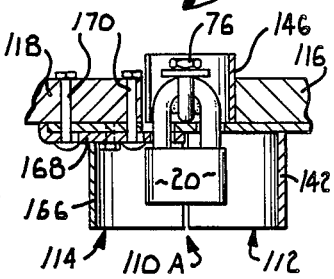
FIG. 7 is a horizontal cross-sectional view similar to FIG. 5 illustrating another alternative form of the invention.

FIG. 7 illustrates another alternative embodiment of the invention which is designated by the numeral **110*a*. Embodiment 110*a* is identical in use and construction to the embodiment 110 aforedescribed except that instead of hinge plate 68 a stationary plate 168 is mounted on door 118. Also, instead of bolts 70, carriage bolts 170 are utilized to mount plate 168**.

I claim:

1. A device for protecting a padlock when the latter is used to lock together two objects at least one of which is movable between open and closed positions said padlock being characterized by a shackle having first and second arms, joined by a bight portion, and a body, said device comprising;

a first member adapted to be attached to one of said objects and presenting an opening therethrough to receive one of said arms of said shackle;

a second member adapted to be attached to the other of said objects, said second member presenting an opening therethrough to receive the other arm of said shackle when said objects are in their closed positions;

shield means extending outwardly from each of said members in a manner so that the members cooperate to surround said body when said objects are in their closed positions; and cover plate means projecting from the side of one of said members which side is opposite said shield means, said cover plate means protecting said bight portion when said arms are placed through the respective openings in said members.

2. A device as set forth in claim 1, wherein is included means for holding said padlock in a substantially stationary position when said arms are through said openings.

3. A device as set forth in claim 1, wherein each of said first and second members includes means for securing said first and second members to a gate post, respectively.

4. A device as set forth in claim 1, wherein each of said first and second members includes means for securing said members to a flat surface.

5. A device as set forth in claim 1, wherein is included means extending inside said bight portion thereby precluding removal of said cover plate means when said padlock is in its locked position.

* * * * *